US006585546B2

(12) United States Patent
Higby et al.

(10) Patent No.: US 6,585,546 B2
(45) Date of Patent: Jul. 1, 2003

(54) METHODS AND APPARATUS FOR RETAINING A PROPSHAFT SUPPORT BEARING HOUSING IN A GEAR CASE

(75) Inventors: Jeffrey P. Higby, Grayslake, IL (US); James A. Mahnich, Lake Villa, IL (US); Erick L. Gruber, Pleasant Prairie, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/969,240

(22) Filed: Oct. 2, 2001

(65) Prior Publication Data

US 2002/0090864 A1 Jul. 11, 2002

Related U.S. Application Data

(63) Continuation of application No. 09/723,788, filed on Nov. 28, 2000.

(51) Int. Cl.[7] ..... B63H 20/32
(52) U.S. Cl. ..... 440/78
(58) Field of Search ..... 440/49, 52, 53, 440/77, 78, 83, 900

(56) References Cited

U.S. PATENT DOCUMENTS 4,948,384 A * 8/1990 Bland et al. ..... 204/196.14
5,018,999 A * 5/1991 Onoue ..... 440/78
6,116,973 A * 9/2000 Higby ..... 440/78

* cited by examiner

*Primary Examiner*—Stephen Avila
(74) *Attorney, Agent, or Firm*—Ziolkowski Patent Solutions Group, LLC

(57) ABSTRACT

The present invention, in one aspect, relates to a propeller shaft housing for being secured in the gear case bore and configured for being securely engaged to the gear case bore by threaded screws that pass through bosses in the housing and into threaded holes in the gear case. More specifically, in an exemplary embodiment, the propeller shaft housing includes at least two bosses having compound angle holes therethrough, and at least two threaded holes in the gear case are arranged to align with one of the respective holes through the bosses. Respective screws extend through the holes in the bosses of the propeller shaft housing and into threaded engagement with the threaded holes in the gear case. In the exemplary embodiment, one of the threaded holes in the gear case is adjacent a skeg, and one of the threaded holes is adjacent a strut. Specifically, the gear case includes a bullet, and a skeg extends generally downward from the bullet and a strut extends generally upward from the bullet when the engine is in an operative position.

39 Claims, 3 Drawing Sheets

METHODS AND APPARATUS FOR RETAINING A PROPSHAFT SUPPORT BEARING HOUSING IN A GEAR CASE

CROSS REFERENCE TO RELATED APPLICATIONS

This application is a continuation application of U.S. application Ser. No. 09/723,788 filed Nov. 28, 2000.

BACKGROUND OF THE INVENTION

The invention relates generally to propshaft housings for marine engines, and more particularly, to preventing relative motion between the propshaft housing and an engine gear case.

Known outboard engines include a drive shaft which extends from the engine power head, through an exhaust case, and into an engine lower unit. The lower unit includes a gear case, and a propeller shaft extends through the gear case. A pinion gear affixed to the lower end of the drive shaft meshes with and drives two gears diametrically opposed to each other and rotationally aligned with the propeller shaft. A clutching member, which is slidingly connected to the propeller shaft, selectively engages one of the drive gears, thereby driving the propeller shaft in the same rotational direction as the engaged gear. One propeller shaft rotational direction provides forward thrust, and the other rotational direction provides reverse thrust. The rotational axis of the propeller shaft is generally perpendicular to the rotational axis of the drive shaft.

A bearing housing, sometimes referred to as a propeller shaft housing or a propshaft housing, is located within the gear case, and the propeller shaft extends through a longitudinal bore in the propshaft housing. Bearings are supported within the propshaft housing bore, and the propeller shaft rotates relative to the propshaft housing on the bearings.

Due to the significant vibrations and power transmitted by the propeller shaft, the propshaft housing should be tightly secured to the gear case to prevent relative motion between the propshaft housing and the gear case. Such relative motion causes wear, which leads to increased clearances between the housing and the gear case. Increased clearances permit greater relative motion, and therefore greater wear, which can result in failure of the gear case, the propshaft housing, the propeller shaft, gears, and/or other components. The propshaft housing should also be removable from the gear case to permit repair and/or replacement of internal components.

Known apparatus attempt to at least limit relative axial, rotational, and lateral movement between the propshaft housing and the gear case. For example, one or more threaded fasteners can be used to limit relative axial motion through a clamping action, and the clamping action also limits relative lateral motion. To limit relative lateral movement, one or more o-rings may be located between the outside diameter of the propshaft housing and inside the bore of the gear case to act as shock absorbers. Due to the elasticity of o-rings, relative lateral motion is reduced, but not eliminated.

Another known retention apparatus for securing a propshaft housing to a gear case includes steel tabs that are tightened against the rear face of the propshaft housing, and the ends of the tabs project radially outward from the outside diameter of the propshaft housing into recesses in the gear case bore. The tab thickness is slightly larger than the distance between the face of the propshaft housing and the rear face of the gear case recess, and the tabs bend slightly when fully tightened against the propshaft housing as the front end of the housing contacts a shoulder in the gear case. This bending of the tabs, which is within the elastic limit of the steel, maintains a high axial load on the propshaft housing against the gear case shoulder, which generates enough friction to prevent rotation of the propshaft housing relative to the gear case. The friction between the tabs, the propshaft housing, and gear case recesses does not, however, always prevent relative lateral movement. The ensuing wear tends to loosen the axial clamp load, which then permits relative rotational movement as well.

In other known engines, threads are formed at the propeller end of the gear case, and after locating the propshaft housing within the gear case, a collar is threadedly secured to the gear case and tightly fits against the propshaft housing. The frictional contact between the propshaft housing and the gear case shoulder, and between the propshaft housing and the collar, effectively prevents rotational and lateral movement of the housing relative to the gear case. To prevent loosening of the collar, a thin washer with an outwardly projecting radial tab and an inwardly projecting radial tab is located between the threaded ring and the propshaft housing. The outer tab fits into a slot in the gear case, and the inner tab is folded over into one of the slots on the inside diameter of the threaded collar. Corrosion and marine growth, however, may make removal of the collar extremely difficult, if not impossible, when servicing is required. In addition, the large exposed threads on both the collar and the gear case can be easily damaged and are relatively expensive to manufacture.

In some other known engines, the propshaft housing includes flanges at the housing aft end, and bolts extend through openings in the flanges and engage the gear case, which totally eliminates rotation of the propshaft housing relative to the gear case. The flanges are tightened against the gear case, which securely positions the propshaft housing axially with respect to the gear case. Although securing the propshaft housing to the gear case in this manner effectively eliminates all relative motion between the aft end of the propshaft housing and the gear case, there may be undesirable hydrodynamic consequences of the flange configuration. The propshaft flange arrangement, therefore, is typically only used for low speed applications, i.e., on small horsepower engines.

Another known retention apparatus employs one or more snap rings expanded into a groove or grooves in the gear case bore at the front end of the propshaft housing, and an annular plate is positioned in front of the snap rings. The plate has two or more threaded holes into which screws are tightened after passing through the front face of the propshaft housing. The snap rings are tightly trapped between the plate and the housing. The snap rings provide an axial locating feature, while the friction between the plate, rings, and housing tends to prevent lateral and rotational movement of the housing relative to the gear case. The prevention of relative lateral movement occurs only at the front of the propshaft housing. Lateral movement at the rear end of the propshaft housing is not reduced or eliminated, and excessive wear can progress quite rapidly. Also, the holes in the propshaft housing through which the screws pass must be sealed to prevent leakage of water into the gear case. Sealing the openings can be tedious and time consuming.

BRIEF DESCRIPTION OF THE INVENTION

The present invention, in one aspect, relates to a propeller shaft housing for being secured in a marine engine gear case bore and configured for being securely engaged to the gear case by threaded screws that pass through bosses in the housing and into threaded holes in the gear case. More specifically, in an exemplary embodiment, the propeller shaft housing includes at least two bosses having holes therethrough, and at least two threaded holes in the gear case are arranged to align with respective holes through the bosses. Respective screws extend through the holes in the bosses of the propeller shaft housing and into threaded engagement with the threaded holes in the gear case.

In the exemplary embodiment, the bosses of the propeller shaft housing are positioned on a same side of a vertical centerline of the gear case, and as the screws are tightened, the screws apply both a forward pressure and a side pressure to the propshaft housing against gear case. The side pressure eliminates movement of propshaft housing in gear case bore. Further, the bosses, screws, and threaded holes in the gear case are positioned on an opposite side of the vertical line as that of the force generated by propeller when in forward gear. As a result, the propshaft housing is tightened to a same side of gear case housing bore as that of the forces generated by propeller in forward gear. Also, the bosses, screws, threads, and propshaft housing are inside the gear case bore. Therefore, no external flow disturbance results from the above described configuration.

DETAILED DESCRIPTION OF THE INVENTION

The present propshaft housing configuration is illustrated and described below in the context of a high performance outboard engine. While the propshaft housing configuration is believed to provide significant benefits for such engines, the configuration is not limited to use in such high performance outboard engines. For example, the propshaft housing could be used in connection with more common outboard engines as well as with stern drive units. Therefore, it should be understood that the propshaft housing configuration is not limited to practice with just high performance outboard engines.

Figure 1:
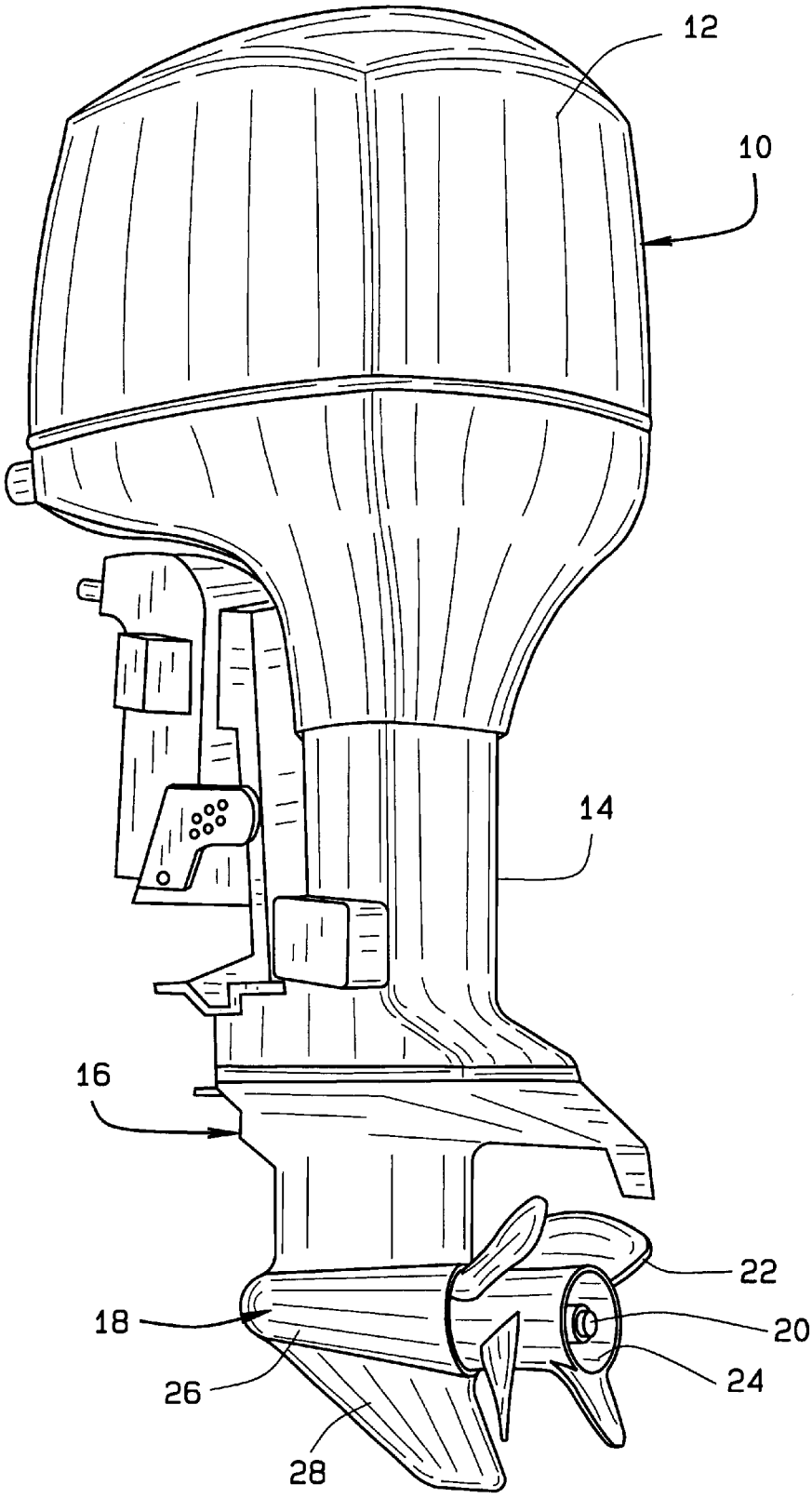
FIG. 1 is a perspective view of an outboard engine.

Referring now particularly to the drawings, FIG. 1 is a perspective view of an outboard engine, such as a high performance 250 horsepower V6 Evinrude® outboard engine commercially available from Outboard Marine Corporation, Waukegan, Ill. Engine 10 includes a cover 12 which houses a power head (not shown), an exhaust housing 14, and a lower unit 16.

Lower unit 16 includes a gear case 18 which supports a propeller shaft 20. A propeller 22 is engaged to shaft 20. Propeller 22 includes an outer hub 24 through which exhaust gas is discharged. Gear case 18 includes a bullet, or torpedo, 26 and a skeg 28 which depends vertically downwardly from torpedo 26.

Figure 2:
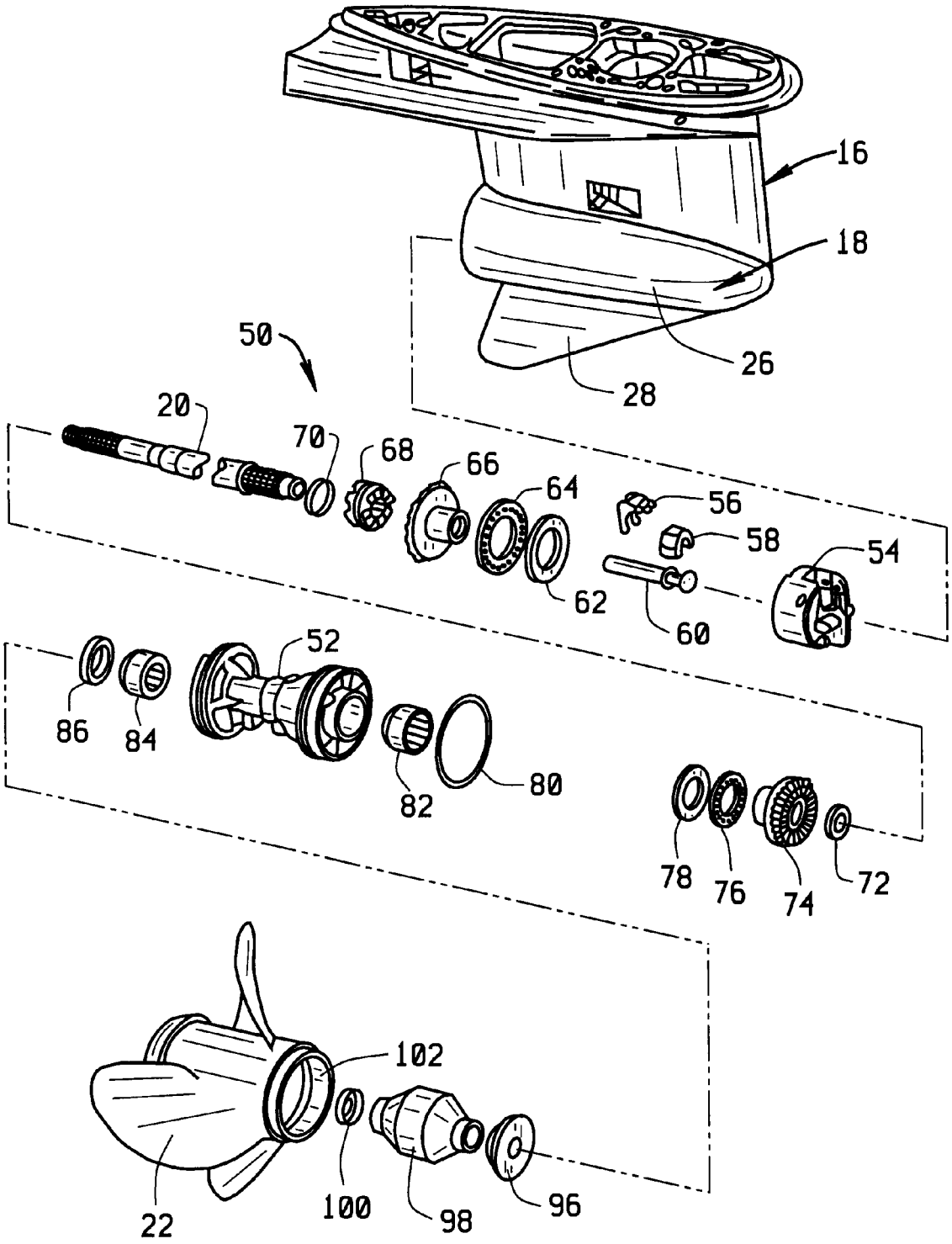
FIG. 2 is an exploded view of a lower unit and propeller shaft assembly.

FIG. 2 is an exploded view of lower unit 16 and a propeller shaft assembly 50. Although components not shown in FIG. 2 typically are included in assembly 50, as is well known in the art, the components illustrated in FIG. 2 are shown by way of example only to illustrate the position of a propshaft housing 52. Assembly 50 includes a housing and bearing assembly 54, and a shift lever 56, a shifter cradle 58, and a shaft 60. Assembly 50 also includes a forward gear thrust washer 62, a forward gear thrust bearing 64, a forward gear 66, a shifter 68, and a spring 70. Assembled at the other end of shaft 20 is a propshaft thrust ring 72, a reverse gear 74, a reverse gear thrust bearing 76, and a reverse gear thrust washer 78.

An O-ring 80 and a bearing 82 are assembled at one end of propshaft housing 52, and a bearing 84 and a seal 86 are assembled at the other end of housing 52. In addition, and although not visible in FIG. 2, screws extend through bosses of housing 52 and into gear case 18.

A thrust bushing 96, a bushing assembly 98, and a sleeve 100 are positioned to be located within propeller bore 102. Propeller shaft 20 extends through propshaft housing 52 and into propeller bore 102 so that propeller 22 can be secured thereto.

Generally, assembly 50 is located within gear case 18, except, of course, propeller 22. Gears 66 and 74 are meshed with and rotationally driven in opposite directions by a pinion gear, which is tightly secured to the drive shaft, which is rotationally driven by the engine. Shifter 68 engages propeller shaft 20 through splines, and can be forced to slide along the splines by operator controlled linkage (not shown). Lugs projecting from each end of shifter 68 selectively engage mating lugs projecting from the face of each gear 66 and 74, thereby causing propeller shaft 20 and propeller 22 to rotate in the desired direction.

Figure 3:
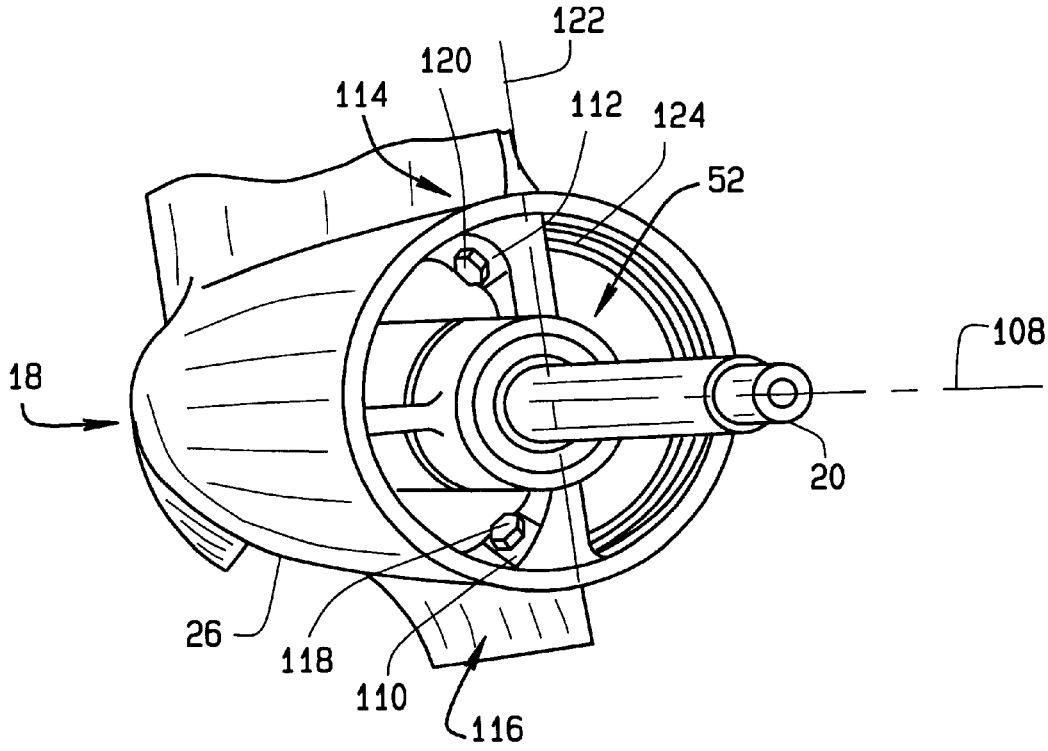
FIG. 3 is perspective view of a propshaft housing located within a gear case.

FIG. 3 is a perspective view of a portion of lower unit 16 including gear case 18 and propeller shaft 20. As shown in FIG. 3, propshaft housing 52 is located within bullet 26 and shaft 20 extends through housing 52 along a shaft longitudinal axis 108. Housing 52 includes bosses 110 and 112 that are offset from each other by about 165 degrees. Compound angle through-holes extend through bosses 110 and 112, and such holes align with threaded holes in thick sections of bullet 26 at a strut area 114 and a skeg area 116. Threaded screws 118 and 120 extend through the holes in respective bosses 110 and 112 and into the threaded holes in strut area 114 and skeg area 116. Screws 118 and 120 are tightened into engagement with gear case 18.

Since screws 118 and 120 are positioned on a same side of a vertical centerline 122 of gear case 18, and due to the compound angle of the holes that extend through bosses 110 and 112, screws 118 and 120 apply both a forward pressure and a side pressure to propshaft housing 52 against gear case 18. The side pressure facilitates eliminating movement of propshaft housing 52 in gear case bore.

In addition, bosses 110 and 112, screws 118 and 120, and the threaded holes in strut area 114 and skeg area 116 are positioned on an opposite side of a vertical line of gear case as that of the force generated by propeller 22 when in forward gear. As a result, propshaft housing 52 is tightened to a same side of gear case housing bore 124 as that of the forces generated by propeller 22 in forward gear. Also, bosses 110 and 112, screws 118 and 120, the threads of openings in gear case 18, and propshaft housing 52 are inside gear case bore 124. Therefore, no external flow disturbance results from the above described configuration.

Rather than having the bosses positioned as shown in FIG. 3, one boss could be positioned on one side of vertical centerline 122 and the other boss could be positioned on the opposite side of vertical centerline 122. Such an arrangement facilitates centering propshaft housing 52 in bore 124, which may simplify manufacturing and assembly processes. Alternatively, both the bosses could be positioned on an opposite side of vertical centerline 122 from the position shown in FIG. 3, e.g., for an oppositely pitched propeller. In addition, other retention mechanisms such as a snap ring or a tab, may be used in combination with the above described retention apparatus.

Figure 4:
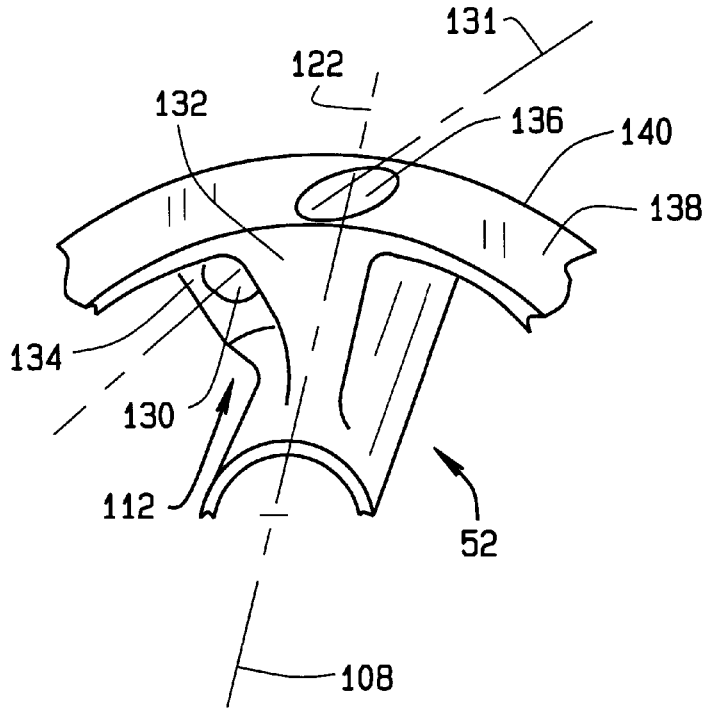
FIG. 4 is a perspective view of a portion of the propshaft housing shown in FIG. 3.

FIG. 4 is a partial perspective view of a portion of propshaft housing 52 illustrating a through-hole 130 through boss 112. Through-hole 130 has a longitudinal axis 131 that extends obliquely to vertical centerline 122 and to shaft longitudinal axis 108. More specifically, boss 112 includes a flat outer face 132 and a flat contact face 134 extending from flat outer face 132 at an obtuse angle relative to flat outer face 132. Through-hole 130 extends substantially perpendicularly through contact face 134 and forms an oblong opening 136 in a top surface 138 of an outer rim 140 of propshaft support housing 52. A threaded hole (not shown) is cut into a thick section of bullet 26 at a strut area 114 that is aligned with through-hole 130 as lower unit 16 is assembled.

When screw 120 (shown in FIG. 3) is inserted through through-hole 130 and driven into the threaded hole in gearcase bullet 26, a longitudinal axis (not shown) of screw 120 is likewise oblique to vertical centerline 122 and shaft longitudinal axis 108, and a screw head (not shown in FIG. 4) is generally flush with flange contact surface 134. The resultant compound angle through through-hole 130 produces forward and side force when propshaft housing 52 is tightened to gear case 18 (shown in FIG. 3). Propshaft housing 52 is therefore supported radially and longitudinally to prevent displacement of propshaft housing 52 relative to gear case 18.

In one embodiment, boss 110 (shown in FIG. 3) is essentially a mirror-image of boss 112 (shown in FIG. 4). Another threaded hole (not shown) is cut into a thick section of bullet 26 at a skeg area 116 (shown in FIG. 3) that is aligned with the through-hole in boss 112. As such, an intersection of extended longitudinal axes of the through-holes of bosses 110 and 112 lies in a plane substantially perpendicular to vertical centerline 122 (shown in FIG. 3) and substantially parallel to shaft longitudinal axis 108 (shown in FIG. 3). Moreover, the point of intersection of longitudinal axes of through-holes of bosses 110 and 112 is longitudinally distanced from, or external to, propshaft support housing along shaft longitudinal axis 108.

In alternative embodiment, one or both of bosses 110 and 112 are constructed differently, or more specifically include contact faces at different angles so as to provide different radial and longitudinal forces when propshaft support housing 52 is tightened to gear case 18.

While the invention has been described in terms of various specific embodiments, those skilled in the art will recognize that the invention can be practiced with modification within the spirit and scope of the claims.

What is claimed is:

1. A marine engine, comprising:

a power head;

an exhaust housing extending from said power head;

a lower unit secured to an end of said exhaust housing, said lower unit comprising a gear ease having a bore therein, a propeller shaft housing secured in said gear case bore, said propeller shaft housing comprising at least two bosses having holes therethrough at a compound angle relative to a shaft longitudinal axis, at least two Threaded holes in said gear ease and arranged to align with one of said respective holes through said bosses, and respective screws extending through said holes in said bosses of said propeller shaft housing and into threaded engagement with said threaded holes in said gear case.

2. A marine engine in accordance with claim 1 wherein said lower unit comprises a bullet, a skeg extending from said bullet, and a strut extending from said bullet, said gear case bore extending into said bullet.

3. A marine engine in accordance with claim 2 wherein one of said threaded holes is adjacent said skeg and one of said threaded holes is adjacent said strut, at least one of said threaded holes extending at a compound angle.

4. A marine engine in accordance with claim 1 wherein said screws are radially spaced about 165 degrees apart.

5. A marine engine in accordance with claim 1 wherein said screws are positioned on a same side of a vertical centerline of said gear case.

6. A marine engine in accordance with claim 1 wherein said screws are positioned on opposite sides of a vertical centerline of said gear case.

7. A marine engine in accordance with claim 1 further comprising at least one tab for being secured to said propeller shaft housing and forming a tight fit with said gear case.

8. A method of mounting a propeller shaft housing in a lower unit drive housing of a marine propulsion unit, the propeller shaft housing having at least two bosses having holes therethrough, the lower unit heaving a gear case with compound angle threaded holes therein arranged to align with respective holes through the bosses, said gear ease also comprising a gear ease bore for receiving the propeller shaft housing said method comprising the steps of:

inserting the propeller shaft housing into the gear case bore;

inserting screws through the holes in the bosses of the propeller shaft housing and into threaded engagement with the threaded holes in the gear case;

tightening the screws so as to limit forward and side movement of the propeller shaft housing relative to the gear case; and wherein the screws are positioned off-center of a vertical centerline of the gear case.

9. A method in accordance with claim 8 further comprising the step of engaging a tab to the propeller shaft housing and into tight fit with the gear case.

10. A method in accordance with claim 8 wherein the screws are positioned on a same side of a vertical centerline of the gear case.

11. A method in accordance with claim 8 wherein the screws are positioned on opposite sides of a vertical centerline of the gear case.

12. A method in accordance with claim 8 wherein the screws are offset about 165 degrees from each other.

13. A kit for a marine engine having a gear ease and a bore therein, said kit comprising a propeller shaft housing for being secured in the gear case bore, said propeller shaft housing comprising at least two bosses having holes therethrough, at least on of said holes extending at a compound angle wherein said bosses are positioned on same side of a vertical centerline of the gear case.

14. A kit in accordance with claim 13 further comprising at least two screws, each of said screws sized to extend through one of said boss holes in said propeller shaft housing.

15. A kit in accordance with claim 13 wherein said bosses are radially spaced about 165 degrees apart.

16. A kit in accordance with claim 13 wherein said bosses are positioned on opposite sides of a vertical centerline of the gear case.

17. A kit in accordance with claim 13 further comprising at least one tab for being secured to said propeller shaft housing and forming a tight fit with the gear case.

18. A propeller shaft housing assembly for a marine engine, the marine engine including a lower unit having a gear case with a bore therein, said assembly comprising:

a propeller shaft housing for being secured in the gear case bore, said propeller shaft housing comprising at least two bosses having holes therethrough, at least two threaded holes in the gear case and arranged to align with one of said respective holes through said bosses; and respective screws for extending through said holes in said bosses of said propeller shaft housing and into threaded engagement with the threaded holes in the gear case at a compound angle relative to a shaft longitudinal axis.

19. A propeller shaft housing assembly in accordance with claim 18 wherein the engine lower unit includes a bullet, a skeg extending from the bullet, and a strut extending from the bullet, the gear case bore extending into the bullet, and wherein one of the threaded holes is adjacent the skeg and one of the threaded holes is adjacent the strut, at least one of the threaded holes extending at a compound angle.

20. A propeller shaft housing assembly in accordance with claim 18 wherein said bosses are radially spaced about 165 degrees apart.

21. A propeller shaft housing assembly in accordance with claim 18 wherein said bosses are positioned on a same side of a vertical centerline of the gear case.

22. A propeller shaft housing assembly in accordance with claim 18 wherein said bosses are positioned on opposite sides of a vertical centerline of the gear case.

23. A propeller shaft housing assembly in accordance with claim 18 further comprising at least one tab for being secured to said propeller shaft housing and forming a tight fit with the gear case.

24. A propeller shaft housing assembly for a marine engine, the marine engine including a lower unit having a gear ease with a bore therein, a propeller shaft extending through the bore, said assembly comprising:

means for supporting the propeller shaft in the gear case bore, said supporting means comprising at least two bosses having compound angle holes therethrough, at least two threaded holes in the gear case arranged to align with said respective holes through said bosses, wherein the compound angle is relative to a longitudinal axis of the propeller shaft; and means for extending through said holes in said bosses of said supporting means and into threaded engagement wit the threaded holes in the gear case.

25. A propeller shaft housing assembly in accordance with claim 24 wherein said supporting means comprises a propeller shaft housing for being secured in the gear case bore.

26. A propeller shaft housing assembly in accordance with claim 24 wherein said bosses are radially spaced about 165 degrees apart.

27. A propeller shaft housing assembly in accordance with claim 24 wherein said bosses are positioned on a same side of a vertical centerline of the gear case.

28. A propeller shaft housing assembly in accordance with claim 24 wherein said bosses are positioned on opposite sides of a vertical centerline of the gear case.

29. A propeller shaft housing assembly in accordance with claim 24 further comprising at least one tab for being secured to said supporting means and forming a tight fit with the gear case.

30. A marine engine, comprising:

a power head;

an exhaust housing extending from said power head;

a lower unit secured to an end of said exhaust housing, said lower unit comprising a gear case having a bore therein, a propeller shaft housing secured in said gear case bore, said propeller shaft housing comprising at least two bosses having holes therethrough, at least two threaded holes in said gear case and arranged to align with one of said respective holes through said bosses, and respective screws extending through said holes in said bosses of said propeller shaft housing and into threaded engagement with said threaded holes in said gear case; and wherein the screws are radially spaced about 165 degrees apart.

31. The marine engine of claim 30, wherein the holes in the bosses are at a compound angle relative to an axis defined by a propeller shaft positioned in the lower unit.

32. A marine engine, comprising:

a power head;

an exhaust housing extending from said power head;

a lower unit secured to an end of said exhaust housing, said lower unit comprising a gear case having a bore therein, a propeller shaft housing secured in said gear case bore, said propeller shaft housing comprising at least two bosses having holes therethrough, at least two threaded holes in said gear ease and arranged to align with one of said respective holes through said bosses, and respective screws extending through said holes in said bosses of said propeller shaft housing and into threaded engagement with said threaded holes in said gear case; and wherein the screws are positioned on a same side of a vertical centerline of said gear case.

33. The marine engine of claim 32, wherein the holes in the bosses are at a compound angle relative to an axis defined by a propeller shaft positioned in the lower unit.

34. A propeller shaft housing assembly for a marine engine, the marine engine including a lower unit having a gear case with a bore therein, said assembly comprising:

a propeller shaft housing for being secured in the gear case bore, said propeller shaft housing comprising at least two bosses having holes therethrough, at least two Threaded holes in the gear case and arranged to align with one of said respective holes through said bosses;

respective screws for extending through said holes in said bosses of said propeller shaft housing and into threaded engagement wit the threaded hales in the gear case; and wherein the bosses are radially spaced about 165 degrees apart.

35. The propeller shaft housing of claim 34, wherein the propeller shaft housing is supported to the gear case both radially and longitudinally with no more than two of the respective screws.

36. The propeller shaft housing of claim 35 wherein the holes in the bosses are at a compound angle relative to a propeller shaft mounted in the base of the gear case.

37. A propeller shaft housing assembly for a marine engine, the marine engine including a lower unit having a gear case with a bore therein, said assembly comprising:

a propeller shaft housing for being secured in the gear case bore, said propeller shaft housing comprising at least two bosses having holes therethrough, at least two threaded boles in the gear case and arranged to align with one of said respective holes through said bosses;

respective screws for extending through said holes in said bosses of said propeller shaft housing and Into threaded engagement with the Threaded holes in to gear case; and wherein the bosses are positioned on a same side of a vertical centerline of the gear case.

38. The propeller shaft housing of claim 37, wherein the holes in the bosses are at a compound angle relative to a propeller shaft mounted in the base of the gear case.

39. The propeller shaft housing of claim 38, wherein the propeller shaft housing is supported to the gear case both radially and longitudinally with no more than two of the respective screws.

* * * * *